United States Patent [19]

Sawa et al.

[11] 4,432,457

[45] Feb. 21, 1984

[54] ARTICLE SELECTION APPARATUS

[75] Inventors: Yuji Sawa; Yozo Kudo, both of Iwaki, Japan

[73] Assignee: Kureha Kagaku Kogyo Kabushiki Kaisha, Tokyo, Japan

[21] Appl. No.: 235,877

[22] Filed: Feb. 19, 1981

[30] Foreign Application Priority Data

Feb. 25, 1980 [JP] Japan ..... 55-22533
Mar. 14, 1980 [JP] Japan ..... 55-32998

[51] Int. Cl.[3] ..... B07C 5/04

[52] U.S. Cl. ..... 209/557; 209/539; 209/555; 209/620; 209/632; 209/652; 209/698

[58] Field of Search ..... 209/620, 632, 522, 540, 209/523, 524, 525, 529, 531, 652, 707, 657, 509, 539, 555, 557, 698

[56] References Cited

U.S. PATENT DOCUMENTS

| | | | |
|---|---|---|---|
| 1,427,264 | 8/1922 | Clear | 209/620 |
| 2,990,952 | 7/1961 | Nigrelli et al. | 209/540 X |
| 2,990,953 | 7/1971 | Mays et al. | 209/620 X |
| 3,552,561 | 1/1971 | Naslund | 209/620 X |

FOREIGN PATENT DOCUMENTS

| | | | |
|---|---|---|---|
| 418007 | 4/1943 | Canada . | |
| 821916 | 9/1969 | Canada . | |
| 154027 | 3/1938 | Fed. Rep. of Germany | 209/620 |
| 2655 | 5/1961 | Fed. Rep. of Germany . | |
| 50-17282 | 2/1975 | Japan . | |
| 845517 | 8/1960 | United Kingdom . | |
| 1075025 | 7/1967 | United Kingdom . | |
| 1348742 | 3/1974 | United Kingdom . | |

*Primary Examiner*—Randolph Reese
*Assistant Examiner*—Donald Hajec
*Attorney, Agent, or Firm*—Wegner & Bretschneider

[57] ABSTRACT

An article selection apparatus is disclosed having a first conveying device for conveying an article along a path and a second conveying device for receiving the article at an entrance end spaced apart by a predetermined distance from a conveying end of the first conveying device and for conveying the received article, wherein the first conveying device has a gap extending along the conveying path to the conveying end thereof, and a width of the gap is made smaller than the predetermined distance from the conveying end of the first conveying device to the entrance of the second conveying device.

14 Claims, 6 Drawing Figures

ARTICLE SELECTION APPARATUS

This invention concerns an article selection device and, particularly, it relates to a device for selecting and discharging the inferior or condemned goods or the defective molded products made of synthetic resins. Containers manufactured from synthetic resin by blow molding inevitably include, to some extent, those defective molded products such as missblown products, semi-molded or partly molded products, defective products with bottom burrs due to unsatisfactory cutting or defective products with protruded bottom due to insufficient evacuation. Accordingly, defective or sub-standard products have been selected and discharged after blow molding either manually or by selection and discharging devices for defective products having various measuring devices and discharging devices in combination for sorting the molded products according to their shapes.

However, as the shapes of the molded products become complicated, number of devices required for the detection of undesired shapes and for discharge of defective molded products is increased, which also result in much more frequent occurrance of failures in the selection and discharging devices and requires the increased time and cost for the production. These problems are more serious when the production line is automated.

In addition, since known selection and discharging devices for defective products are usually designed so as to detect the shape of synthetic resin containers to be checked during transportation of these containers on a conveying means such as a belt conveyor, the shape of the containers can not always be detected accurately and, further, relatively expensive electrical and mechanical devices are necessary for infallibly removing the defective products from the conveying device where the products are transported.

One object of this invention is to provide an apparatus for selecting cylindrical articles having a predetermined size of lateral projections on both sides of the center of gravity of the article from those cylindrial articles having no such lateral projections and from defective articales having a projection much smaller than the predetermined size and, in particular, a selection and discharging apparatus for defective molded products or a selection apparatus for conforming molded products or non-defective molded articles capable of surely selecting and discharging defective molded products made of synthetic resin depending on their defective shapes from those cylindrical molded products having molded shape diverging near the both ends of each product.

The above-mentioned object is attained by an article selection apparatus comprising a first conveying means for conveying an article along a path and a second conveying means for receiving the article at an entrance end spaced apart by a predetermined distance from a conveying end of the first conveying means and for conveying the received article, wherein the first conveying means has a gap extending along the conveying path to the conveying end thereof, and a width of the gap is made smaller than the predetermined distance from the conveying end of the first conveying means to the entrance of the second conveying means.

Another object of this invention is to provide a selection and discharging apparatus for defective molded products or an apparatus for selecting non-defective articles which has a relatively simple structure and is capable of surely selecting and discharging defective molded products.

Said another object is attained by the article selection apparatus which further comprises a stopper for abutting against a downstream end of the article to be selected which is conveyed by the second conveying means and for stopping the article, a discrimination means for discriminating a shape of the article abutted at the downstream end thereof against the stopper and for generating discriminating signals, a third conveying means having an entrance portion adjacent to the second conveying means, a pushing means for pushing out the article to be selected to the entrance portion of the third conveying means, a selection member for guiding the pushed out article to the entrance portion of the third conveying means when the selection member is set at a first position and for guiding the pushed out article outside of the third conveying means when the selection member is set at a second position, and a setting means for setting the selection member according to the discriminating signals from the discrimination means.

This invention is to be described in more details referring to the accompanying drawings, by which the foregoing and other objects as well as the features of this invention will be made clearer in which:

FIGS. 1(a), (b) are perspective views of the selection apparatus of a preferred embodiment according to this invention;

Figure 1:
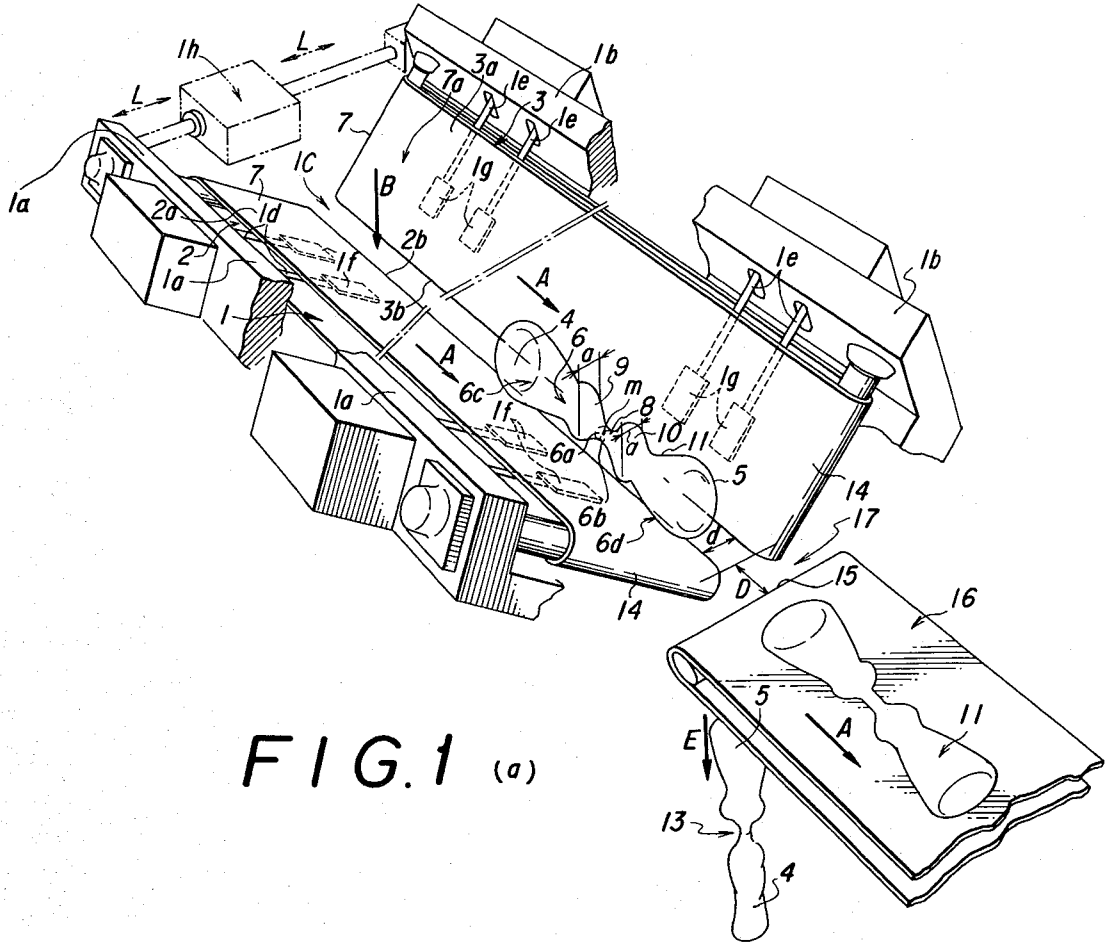
Figure 1:
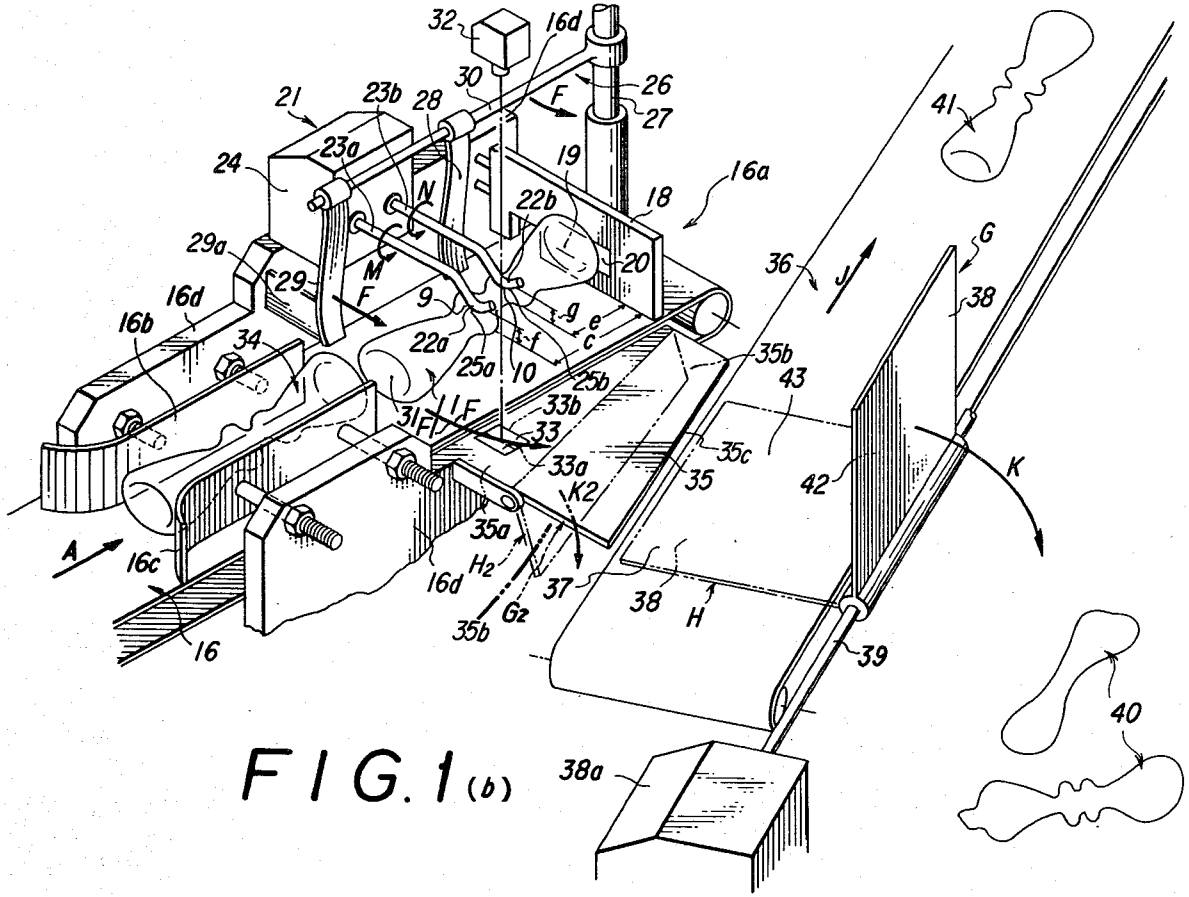
Figure 2:
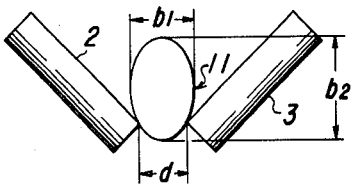
FIG. 2 is an explanatory side view of the apparatus conveying a non-defective article shown in FIG. 1(a)
Figure 3:
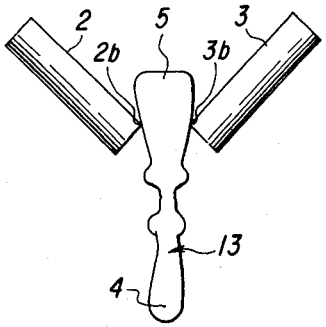
FIG. 3 is an explanatory view illustrating selection and discharging of defective molded products by the apparatus shown in FIG. 1(a)
Figure 3:
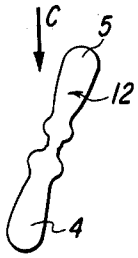

In the drawings, a V-shaped conveyor 1 as the first conveying means is supported on frames 1*a*, 1*b*. The conveyor 1 comprises two belts or belt conveyors 2, 3, which are provided adjacent to each other with a gap 1C having a width d in the direction perpendicular to the conveying direction A. The two belts 2, 3 are inclined to each other, and each belt is set with an equal angle relative to the horizontal plane so as to co-operatively form a V-shape. A molded product 6 made of synthetic resin by way of blow molding so as have a shape diverging at both end portions 4, 5 is fallen in the direction B down to the position 7*a* near the entrance 7 of the V-shaped conveyor 1. Specifically, the molded product 6 has diverging portions 4, 5 as projections projecting laterally on both sides of its center of gravity m. The molded product 6 may, for example, comprise a container pair 6 consisting of two identical containers 6*c*, 6*d*, each having an opening 6*a*, 6*b* with reduced size and joined to each other at a portion 8 to be an inlet of each container 6*c*, 6*d*. Each of the containers 6*c*, 6*d* of the container pair 6 has a projection 9, 10 projecting laterally near the inlet 8. In a conforming or non-defective container pair 6, the minimum transverse or lateral length a at the projections 9, 10 is smaller than the width d of the gap 1C, the minimum transverse or lateral length b1 at the projected ends 4, 5 is greater than the width d of the gap 1C and the maximum transverse or lateral length b2 at the ends 4, 5 is smaller than the width D described later. The projections 9, 10 may not always be provided. On the contrary, the projections 9, 10 may be greater than the ends 4, 5. In this case, the minimum transverse length of the projections 9, 10 is greater than the width d, the maximum transverse length of the projections 9, 10 is smaller than the width D and the minimum transverse length of the ends 4, 5 is smaller than the width d. Since the conveying surfaces 2*a*, 3*a* of the V-shaped conveyor 1 is inclined downwardly to the gap 1C, the container pair 6 fallen on the conveyor 1 is arranged on the conveyor 1 along the conveying direction A. That is, the longitudinal direction of the container pair 6 coincides with the conveying direction A. The belts 2, 3 may be vibrated so as to arrange the container pair 6 in the direction A. For the vibration of the belts 2, 3, rod members 1*d*, 1*e* whose one ends are supported on the frame 1*a*, 1*b* and whose other ends are positioned opposing to the rear surfaces of the belts 2, 3 are provided, with vibration members 1*f*, 1*g* such as of electromechanical vibrators attached to the other ends of the rod members 1*d*, 1*e* in order to strike the rear surfaces of the belts 2, 3. Alternatively, vibration means 1*h* may be provided between the frames 1*a*, 1*b* so as to vibrate at least one of the belts 2, 3 in the direction L perpendicular to the direction A. In the case where the container pair 6 is arranged along the direction A and if this container pair 6 is a container pair 11 having molded ends 4, 5 projected by a predetermined size, the cntainer pair 11 is conveyed in the direction A while supported at both of the projecting ends 4, 5 on the belts 2, 3 as shown in FIG. 1*a*. However, if the container pair 6 is a defective miss-blown container pair 12, in which both of the projecting ends 4, 5 are not diverged to the predetermined size, it is fallen downwardly through the gap 1C of the conveyor 1 as shown by arrow C upon arrangement in the direction A (FIG. 3). Consequently, the defective molded container pair 12 miss-blown with respect to its both ends 4, 5 is selected from other molded container pair in the conveyor 1 and discharged from the conveyor 1 in the direction C as shown in FIG. 3. In the case of a defective miss-blown container pair 13 in which either one of the projecting ends 4, 5, for example, only the end 4 is not diverged to the predetermined size, such a defectively molded end 4 of the container pair 13 passes downwardly through the gap 1C when the container pair 13 is arranged in the direction A. However, the container pair 13 is still supported by the conveyor 1 as the other end 5 molded to the predetermined size is engaged with the inner edges 2*b*, 3*b* of the belts 2, 3. And the container pair 13 is conveyed by the conveyor 1 with its downwardly directed difective end 4.

Figure 4:
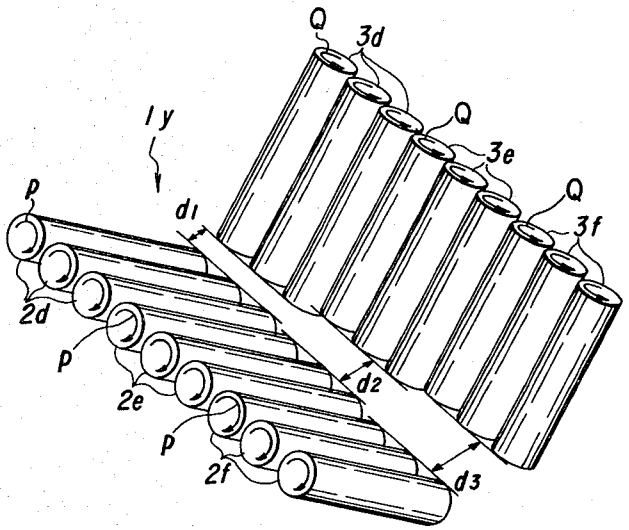
FIG. 4 is an oblique view of a modified embodiment of a V-shaped conveyor.

The conveyor 1 can be applied to various different sizes of container pairs by making the width d of the gap 1C adjustable, for example, by the connection means 1*h*. In place of the belts 2, 3, a V-shaped conveyor 1*y* having different gap widths d1, d2, d3, may be provided by using plurality of rollers 2*d*, 2*e*, 2*f* and 3*d*, 3*e*, 3*f* of different axial length as shown in FIG. 4. Arrows P and Q show the rotational directions of the rollers 2*d*, 2*e*, 2*f* and 3*d*, 3*e*, 3*f* respectively. In the V-shaped conveyor 1*y*, the container pairs 6 can be selected depending on the transverse or lateral sizes, or the extent of defective molding of the container pairs 6 due to miss-blowing and the like. Further, for the molded container pairs in which the transverse length of the projecting portions 9, 10 are made greater than the transverse length of the ends 4, 5, the width d of the gap 1C may be set so that the projecting portions 9, 10 can be supported on the belts 2, 3 if they are molded to the desired sizes. In addition, the cross-sectional configuration of the container pair 6 perpendicular to the longitudinal direction thereof may be of any shapes such as circular, eliptic or rectangular shape. For the container pair 6 having a cross-sectional configuration other than the circular shape, it is desired to vibrate the belts 2, 3.

A conveyor 16 as the second conveying means is disposed for receiving, at the entrance or entrance end 15 thereof, the container pair 6 conveyed on the conveyor 1 to the conveying end 14 of the conveyor 1 in the direction A and for conveying the received container pair 6 further in the direction A. A gap 17 having the width D in the transfer direction A of the container pair 6 is provided between the entrance end 15 of the conveyor 16 and the conveying end 14 of the V-shaped conveyor 1. The width D of the gap 17 is greater than the maximum transverse length b2 of the container pair 6 and smaller than one-half of the longitudinal length of the container pair. In the case where the container pair 6 is formed as the container pair 11 whose ends 4, 5 are molded saitsfactorily, the container pair 11 is sent out from the conveying end 14 of the conveyor 1, received by the conveyor 16 at its entrance end 15 and then further conveyed in the direction A on the conveyor 16. The conveying direction of the conveyor 16 may not necessarily be equal to the direction A provided that the width D of the gap 17 is maintained to a predetermined dimension. On the contrary, if the container pair 6 is formed as the container pair 13 in which either one of the ends 4, 5, for example, only the end 4 of the container pair 13 is defectively molded, the container pair 13 which has been transported in upright position is fallen through the gap 17 in the direction E upon delivery from the conveying end 14 of the conveyor 1 and, therefore, not transported to the conveyor 16, because the gap width D is greater than the maximum transverse length of the end 5.

Accordingly, the container pair 13 is selected by the combination of the gap 1C in the V-shaped conveyor 1 and the gap 17 between the V-shaped conveyor 1 and the conveyor 16, and then discharged through the gap 17. As the result, the container pairs 6 conveyed on the belt 16 in the direction A do not include those miss-blown container pairs 12, 13, whose ends 4, 5 are not sufficiently blown, but include only those container pairs 11 having projecting ends 4, 5 molded to the desired transverse length.

At the downstream area 16*a* of the conveyor 16 as the second conveying means, is provided a stopper 18, and the stopper 18 abuts against one end face 19 of the container pair 11 to stop the movement of the container pair 11 which has been conveyed while arranged by guide plates 16*b*, 16*c* disposed as arranging means. The guide plates 16*b*, 16*c* and the stopper 18 are secured to a frame 16*d*. The stopper 18 is provided with a switch 20 which is actuated by the end face 19 of the container pair 11 when the end face 19 comes into contact with the switch 20. A shape detector 21 as a discrimination means is disposed at a desired position near the stopper 18 for the detection of the shape of the projections 9, 10. Under the actuation of the switch 20, the detector 21 detects whether the projections 9, 10 of the container pair 11 are respectively formed at predetermined distances c, e from the end 19 and as well as whether the transverse length f, g of the container pair 11 at the projections 9, 10 are formed to predetermined values. The detector 21 comprises detection rods 23*a*, 23*b* having detection ends 22a, 22b, for example, in a curved configuration usually protruded downwardly, and a detector section 24 for detecting the angle of rotation of the rods 23a, 23b in the directions M and N respectively. When the container pair 11 substantially stops by being abutted at the end face 19 against the stopper 18 and the switch 20, the detector 21 discriminates whether the upper ends 25a, 25b of the projections 9, 10 situate at predetermined heights f, g at the positions spaced apart by predetermined distances c, e from the stopper 18 by detecting, at the detection section 24, the angle of rotations of the detection rods 23a, 23b which are rotationally displaced in accordance with the abutment between the detection ends 22a, 22b and the upper ends 25a, 25b. In the case where the non-defective container pair has no such projections 9, 10, the detector 21 may be omitted. Although the detector 21 detects, in this embodiment, whether the projections 9, 10 are projected by a predetermined extent laterally at predetermined longitudinal positions c, e, the longitudinal positions c, e and the lateral projecting sizes or transverse lengthes f, g may be detected independently.

Near the stopper 18, a transfer device 26 is provided as a pushing means operated by the actuation of the switch 20. The transfer device 26 comprises a horizontally extending rod 30 which is connected at one end thereof to a pivotal vertical shaft 27 rotatably mounted to a driving device (not shown) provided to the frame 16d and connected at the other portion near the other end thereof to two transfer members 28, 29. The horizontally projecting planar member 29a is fixed at one end thereof to a lower end of the transfer member 29. The transfer members 28, 29 and the rod 30 constitute a push-out member which is pivotted together with the shaft 27. The rod 30 may be pivotally mounted on the shaft 27. When the transfer device 26 is operated, the rod 30 is rotated around the shaft 27 in the direction F by the driving device and the transfer member 28, 29 are also rotated in the direction F by the rotation of the rod 30 in the direction F. By the rotation, the transfer members 28, 29 rotationally displace the container pair 11 in the direction F. A light source 32 and a photo-receiving device 33 as discrimination means are disposed vertically facing to each other respectively above and below the substantially circular arc-shaped moving path F1 which is traced by the other end or upstream end 31 of the container pair 11 in the substantially arc-shaped displacement of the container pair 11 in the direction F, and they detect whether the longitudinal length of the container pair 11 from the end 19 to the end 31 is formed to a predetermined size. It should be noted that the downstream end 19 of the container pair 11 abuts against the stopper 18 during the initial stage of push-out operation including the period when the longitudinal length of the container pair is detected. By the detection of the longitudinal length, absence or presence of so-called burrs at the bottom due to defective cutting at the end face or so-called protrusions at the bottom due to unsatisfactory evacuation are detected. The light beams from the light source 32 to the photo-receiving device 33 are interrupted by the container pair 11 if it has the bottom burrs or bottom protrusions but the beams are not interrupted if the container pair 11 has no bottom burrs and if the length between the end faces 19, 31 of the container pair 11 is formed to the predetermined size. The photo-receiving device 33 may, alternatively, be formed with two photo-receivers 33a, 33b so that the light beams to both of the photo-receivers 33a, 33b are interrupted by the container pair 11 which has the burrs or the likes, while the beams only to the photo-receiver 33b are interrupted by the container pair 11 and the beams to the photo-receiver 33a are not interrupted by the container pair 11 if it has the predetermined length. The detection for the predetermined length of the container pair 11 is carried out at the position where the container pair 11 is rotationally displaced by a predetermined amount in the direction F under the rotational displacement of the transfer member 28 and the transfer member 29 having the projection 29a in the direction F. Therefore even if a succeeding container pair 34 is conveyed near the end face 31 of the container pair 11, the container pair 34 is stopped by the projection 29a upon rotational displacement of the transfer members 28, 29 and the end face 31 of the container pair 11 is spaced apart from the container pair 34 upon detection of the longitudinal length, to avoid the fear of errorneous length detection. In addition, since the container pair 11 is substantially abutted at a portion of the end face 19 against the stopper 18 when the detection of the longitudinal length of the container pair 11 is carried out at the position rotated by the predetermined amount in the direction F, the detection of the longitudinal length is carried out under the state where the container pair 11 substantially rests stationary, by which the detection accuracy can be improved. Further, since the container pair 11 is urged to the stopper 18 by the frictional force due to the movement of the conveyor 16, the end face 19 can be securely positioned on one face of the stopper 18, when the container pair 11 is rotated in the direction F. The next container pair 34 can be transported to a position to abut against the stopper 18, when the transfer members 28, 29 including the projection 29a is reset back to the original position.

Figure 5:
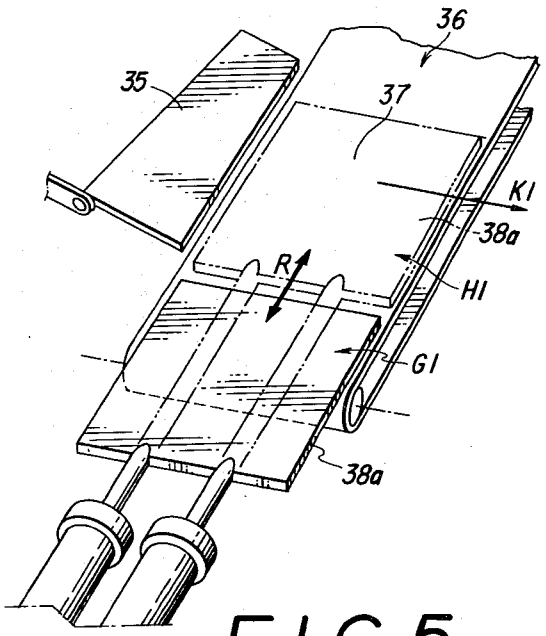
FIG. 5 is an oblique view of a modified embodiment of a shutter.

An entrance portion 37 of a lift conveyor 36 as a third conveying means is provided below the end 35c of the transfer path 35 for the container pair 11 by the transfer device 26 in the direction F. Near the entrance 37 is provided a shutter 38 as a selection member which is controlled to take one of two positions G and H by a driving device 38a as a setting means depending on the output discriminating signals from the detectors 21, 33. The shutter 38 is rotationally displaced around a shaft 39 by the driving device 38a as a setting means. The driving device 38a sets the shutter 38 to its vertical or upright position G on every actuation of the switch 20, and sets the shutter 38 to its horizontal position H when it receives defective product detection signals as the discriminating signals from at least one of the detectors 21, 33 which has discriminated that the container pair 11 is a defective product 40. When none of the detectors 21, 33 issue the defective product detection signals as the discriminating signals, the shutter 38 is kept to be set at the position G by being judged that the container pair 11 is conforming or non-defective product 41. In this case the container pair 11 transferred by the transfer device 26 on the transfer path 35 is fallen onto the entrance 37 of the conveyor 36 while guided by one surface 42 of the shutter 38 and then conveyed as the conforming product 41 in the direction J by the conveyor 36 for subsequent fabrication, if necessary. Thus, the shutter 38 on the position G serves as a stopper for preventing the non-defective container pair 41 from falling down out of the entrance 37. On the other hand, in the case where the container pair 11 is judged to be the defective product 40 and the shutter 38 is set to the position H, the defective container pair 40 transferred from the transfer path 35 falls on the other surface 43 of the shutter 38 since the shutter 38 is situated at the position over-laying the entrance 37 of the conveyor 36. The defective container pair 40 on the surface 43 falls as the defective product 40 in the direction K when the shutter 38 returns to the position G. In place of being rotated around the shaft 39, the shutter may be moved in parallel in the direction R along an inclined plane between a position H1 over-lying the entrance 37 for discharging the defective container pair 40 in the direction K1 and a position G1 not over-laying the entrance 37 to allow or guide the non-defective container pair to be placed on the conveyor 36, so that the shutter 38*a* may open and close the falling path of the container pair 11 from the transfer path 35 to the entrance 37 as shown in FIG. 5. Further, the plate member forming the transfer path 35 may be formed with two members 35*a*, 35*b*, in which the member 35*b* is made pivotable between a position G2 forming the same plane as the member 35*a* to guide the non-defective container pair 41 to the entrance 37 and a position H2 inclined down from the member 35*a* to discharge the defective container pair 40 in the direction K2. Furthermore, shape discrimination means such as the detectors 21, 33 can be modified depending on the shapes of the containers to be discriminated as required. Particularly, the device shown in FIG. 1(b) can be applied to the discrimination of various shapes of articles.

As described above, the apparatus according to this invention can surely select and discharge defective molded products according to the defective shapes of the articles or the defect-generating processes from the non-defective cylindrically molded synthetic resin products having diverging portions near both ends.

Although the apparatus of this invention has been explained in the foregoing description for the embodiments in which the apparatus of this invention is applied to the detection of defective molded products of the molded synthetic resin containers, the apparatus of this invention can also be employed for selecting cylindrical article having lateral projections on both sides of the center of gravity of the article from those cylindrical articles having defective lateral projections.

What is claimed is:

1. An article-selection apparatus comprising a first conveying means for conveying an article, a second conveying means for receiving said article at an entrance end spaced apart by a predetermined distance from a conveying end of said first conveying means and for conveying the received article, a stopper for abutting against a downstream end of said article to be selected and conveyed by said second conveying means and for stopping said article, a discrimination means for discriminating a shape of said article abutted against said stopper at said downstream end thereof and for generating discriminating signals, a third conveying means having an entrance portion adjacent to said second conveying means, a pushing means for pushing said article to be selected out to said entrance portion of said third conveying means, a selection member for guiding the pushed-out article to said entrance portion of said third conveying means when said selection member is set to a first position and for guiding said pushed-out article outside of said third conveying means when said selection member is set to a second position, and a setting means for setting the position of said selection member according to said discriminating signals from said discriminating means, said first conveying means having a gap which extends along the conveying path to a conveying end thereof and said gap having a width smaller than said predetermined distance from said conveying end of said first conveying means to said entrance end of said second conveying means and said first conveying means comprising two conveying sections each of which has a conveying surface downwardly inclined to said gap.

2. The apparatus of claim 1, in which an arranging means for spacially arranging the article which is conveyed by the second conveying means and abutted against the stopper is provided on an upstream portion of the stopper.

3. The apparatus of claim 2, in which the arranging means comprises a pair of guide plates.

4. The apparatus of claim 1, in which the discrimination means comprises means for discriminating whether a length of the article from the downstream end thereof to an upstream end thereof is a predetermined length.

5. The apparatus of claim 1, in which the upstream end of the article is pushed out by the pushing means in a state where the article is abutted at the downstream end thereof against the stopper at an initial stage of the pushout operation.

6. The apparatus of claim 5, in which the discrimination of the length of the article from the downstream end to the upstream end by the discrimination means is conducted at the initial stage of the push-out operation by the pushing means.

7. The apparatus of claim 6, in which the discrimination means further comprises means for discriminating the lateral size of the article.

8. The apparatus of claim 5, in which the pushing means comprises a pivotal vertical shaft and a push-out member extending horizontally from the vertical shaft.

9. The apparatus of claim 1, in which the second conveying means is a belt conveyor.

10. The apparatus of claim 1, in which the selection member is made rotatable between the first position and the second position, and the selection member over-lays the entrance portion of the third conveying means when the selection member situates at the second position.

11. The apparatus of claim 10, in which the selection member, serves as a stopper for preventing the pushed-out article by the pushing means to the entrance portion of the third conveying means from falling out of the entrance portion, when the selection member is set to the first position.

12. The apparatus of claim 1, in which the selection member is moved in parallel between the first position and the second position.

13. The apparatus of any one of claims 2–12, in which the article is formed out of synthetic resin and the apparatus is a selecting and discharging apparatus for defectively formed article.

14. The apparatus of claim 13, in which the article comprises a container pair comprisising two identical containers joined together at identical openings thereof.

* * * * *